US005918297A

United States Patent [19]

Pliassov

[11] Patent Number: 5,918,297

[45] Date of Patent: Jun. 29, 1999

[54] BOW FOR STRING INSTRUMENT AND IMPROVED STRING INSTRUMENT

[76] Inventor: Vladimir Pliassov, Holand, N-8370, Leknes, Norway

[21] Appl. No.: 08/793,194

[22] PCT Filed: Aug. 31, 1995

[86] PCT No.: PCT/NO95/00146

§ 371 Date: Feb. 20, 1997

§ 102(e) Date: Feb. 20, 1997

[87] PCT Pub. No.: WO96/07176

PCT Pub. Date: Mar. 7, 1996

[30] Foreign Application Priority Data

Aug. 31, 1994 [NO] Norway ..... 943216
Jul. 28, 1995 [NO] Norway ..... 953006

[51] Int. Cl.[6] ..... G10D 1/02

[52] U.S. Cl. ..... 84/282; 84/283; 84/274; 84/293

[58] Field of Search ..... 84/282, 283, 274, 84/293

[56] References Cited

U.S. PATENT DOCUMENTS 384,045 6/1888 Latchmore ..... 84/282
613,897 11/1898 Bowser .
1,027,636 5/1912 Adams ..... 84/282
1,714,490 5/1929 Berkowski ..... 84/282
3,822,628 7/1974 Quemore, Sr. .
4,132,143 1/1979 Stone ..... 84/293

FOREIGN PATENT DOCUMENTS 364771 12/1922 Germany .
435878 10/1926 Germany .
463203 7/1928 Germany .

*Primary Examiner*—William M. Shoop, Jr.
*Assistant Examiner*—Kim Lockett
*Attorney, Agent, or Firm*—Young & Thompson

[57] ABSTRACT

A bow for a stringed instrument in which the tension of the hair (4) of the bow can be tightened and loosened by the performer while playing. The stick is divided into two parts (2,3). The parts (2,3) of the stick are rotatably joined about an axis (6). At least one of the parts (2,3) of the stick is extended in the form of an arm (5) from the axis (6) and the arm (5) can function as a lever for tightening the hair (4) of the bow by the performer's exertion of pressure between the arm (5) and the other part (2,3) of the stick.

12 Claims, 12 Drawing Sheets

BOW FOR STRING INSTRUMENT AND IMPROVED STRING INSTRUMENT

BACKGROUND OF THE INVENTION

The present invention relates to a bow for a stringed instrument, such as, for example, a violin, viola, cello, double bass and so forth, where the tension of the hair can be freely adjusted during the playing so as to make possible the playing on one string or on two or more strings simultaneously.

In addition, the invention relates to a stringed instrument adapted for the use of this novel bow.

DESCRIPTION OF THE RELATED ART

Stringed instruments are normally played with a bow having relatively taut hair. The hair of the traditional bow for stringed instruments, Tourte's bow, can be adjusted by means of a tightening screw. This adjustment must be carried out prior to the playing or during pauses in the playing. If it is necessary to draw the bow across more than two strings at once, such a bow will require that great force be used to press it against the strings, thus making it impossible to play long notes and to play softly or pianissimo.

For a long time there has been a need for a bow to be used with stringed instruments which allows a swift adjustment of the tension of the hair. Thus, for several centuries there has been known a violin bow forming a deep arc wherein the hair is attached with a great deal of slack at both ends of the bow.

When the musician starts to play, he grips one side of the bow and pulls with his thumb the hair toward the side of the bow, thereby tightening and loosening the hair while playing. To make this type of adjustment while playing is very exhausting and, because of the anatomical structure and movement pattern of the human arm, it is impossible to utilize the whole length of this bow for playing.

German Patent Publication 364,770 teaches a plurality of embodiments of a violin bow where the tension of the hair can be adjusted during performance by means of a handle with cord/wire transfers.

According to one embodiment, the player can adjust the tension of the hair directly by a cord/wire transfer between the handle on the bow and one of the attachment points of the hair of the bow.

In another embodiment the bow consists of two parts rotatably attached to each other. The hair of the bow can be tightened and loosened by the two parts of the bow being rotated in relation to each other, the tightening being here made by a cord/wire transfer from the handle of the bow rotating the two parts of the bow in relation to each other.

This known bow has the disadvantage that it, because of the placement of the handle, severely hampers the movement of the arm during the playing. Thus, this bow has not been used much.

Modern stringed instruments are primarily designed for the use of the traditional bow. Because of the relative taut hair of the modern bow, and for the purpose of facilitating changes when different strings and, particularly, chords are played, the common stringed instruments are built with a relatively flat bridge and correspondingly flat fingerboard, so that the angle between the planes defined between one string and its two neighboring strings in the area in which the player under normal playing draws the hair of the bow becomes relatively small, for a violin typically about 14–23°. This angle is different for the different strings and varies greatly from a small violin, such as a ⅛ violin, where the angle typically is 14–17°, to a double bass where the angle often is about 25°. A corresponding angle is also formed between the plane defined by the outermost string and the neighboring string, and the plane defined between the outermost sting and the edge of the resonance box. When bows capable of being tightened and loosened during playing are used, it turns out that it in practice may prove difficult and highly strenuous to tighten the hair as much as it is tightened on a traditional bow for stringed instruments. For this reason, a situation may easily occur in which the player is unable to tighten the bow sufficiently to play on one string only, when this is desirable, particularly when he shall play forcefully.

SUMMARY OF THE INVENTION

It is an object of the present invention to provide a new bow for stringed instruments which is capable of overcoming the problems mentioned above. It is a further object to provide a new stringed instrument adapted to be played with the new bow of the invention.

The first object is achieved, according to the present invention, by means of a bow for stringed instruments where the hair of the bow can be tightened and loosened by the performer while playing, where the stick is divided into two parts, where the parts of the stick are rotatably joined about an axis, where at least one of the parts of the stick is extended in the form of an arm from an axis and where the arm can function as a lever for tightening the hair of the bow when the performer exerts pressure between the arm and the other part of the stick.

The second object is achieved, according to the present invention, by means of a stringed instrument to be used with the bow described above, where the angle between the planes defined by a string and its two neighboring strings in the area in which the hair of the bow is normally drawn across the strings is at least 3°, preferably at least 5° and most preferably at least 7° greater than what is usual for this type of instrument, i.e., instruments having the same length of string.

BRIEF DESCRIPTION OF THE DRAWINGS

The invention will now be described with reference to the enclosed drawings, where

FIG. 12 shows an embodiment of an exchangeable fingerboard according to the invention;

FIG. 13 shows an embodiment of an adapter for releasable adhesion to the fingerboard of the instrument;

DESCRIPTION OF THE PREFERRED EMBODIMENTS

Figure 1:
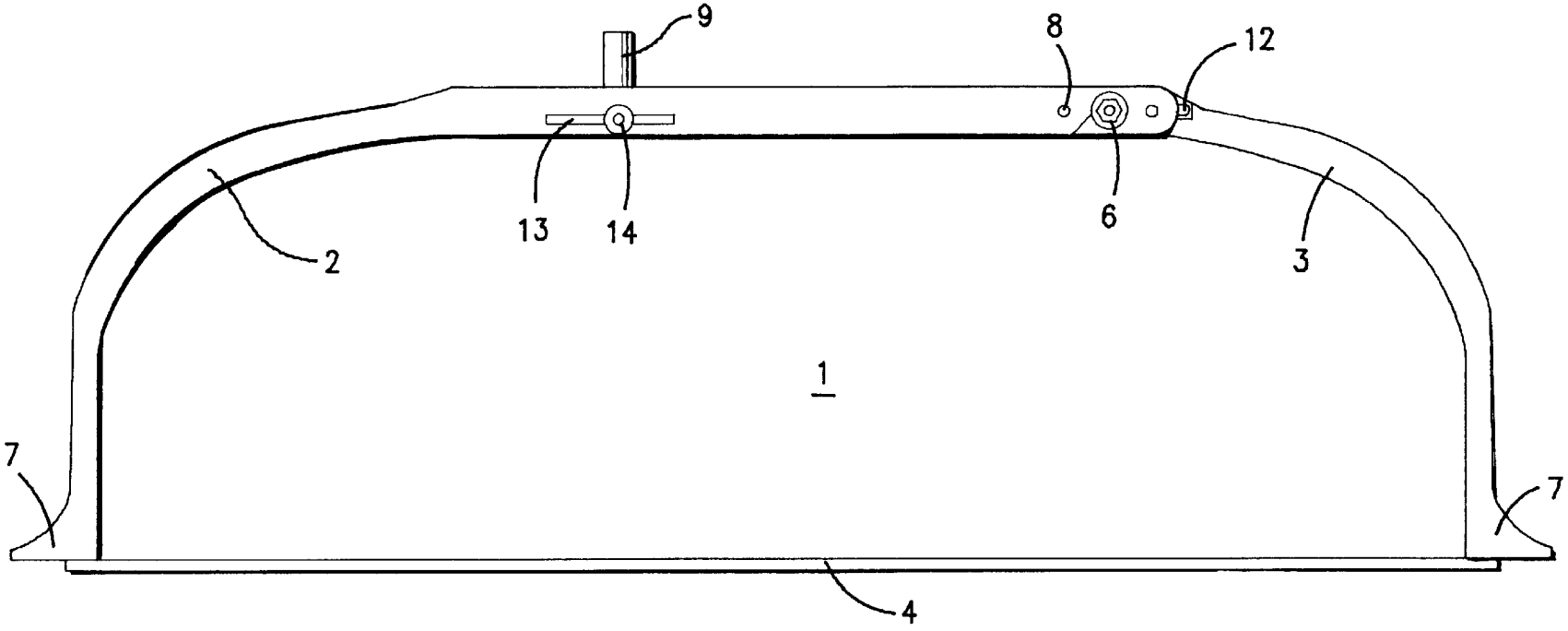
FIG. 1 shows an embodiment of the present bow for stringed instruments in a position of tension, seen from the side.
Figure 2:
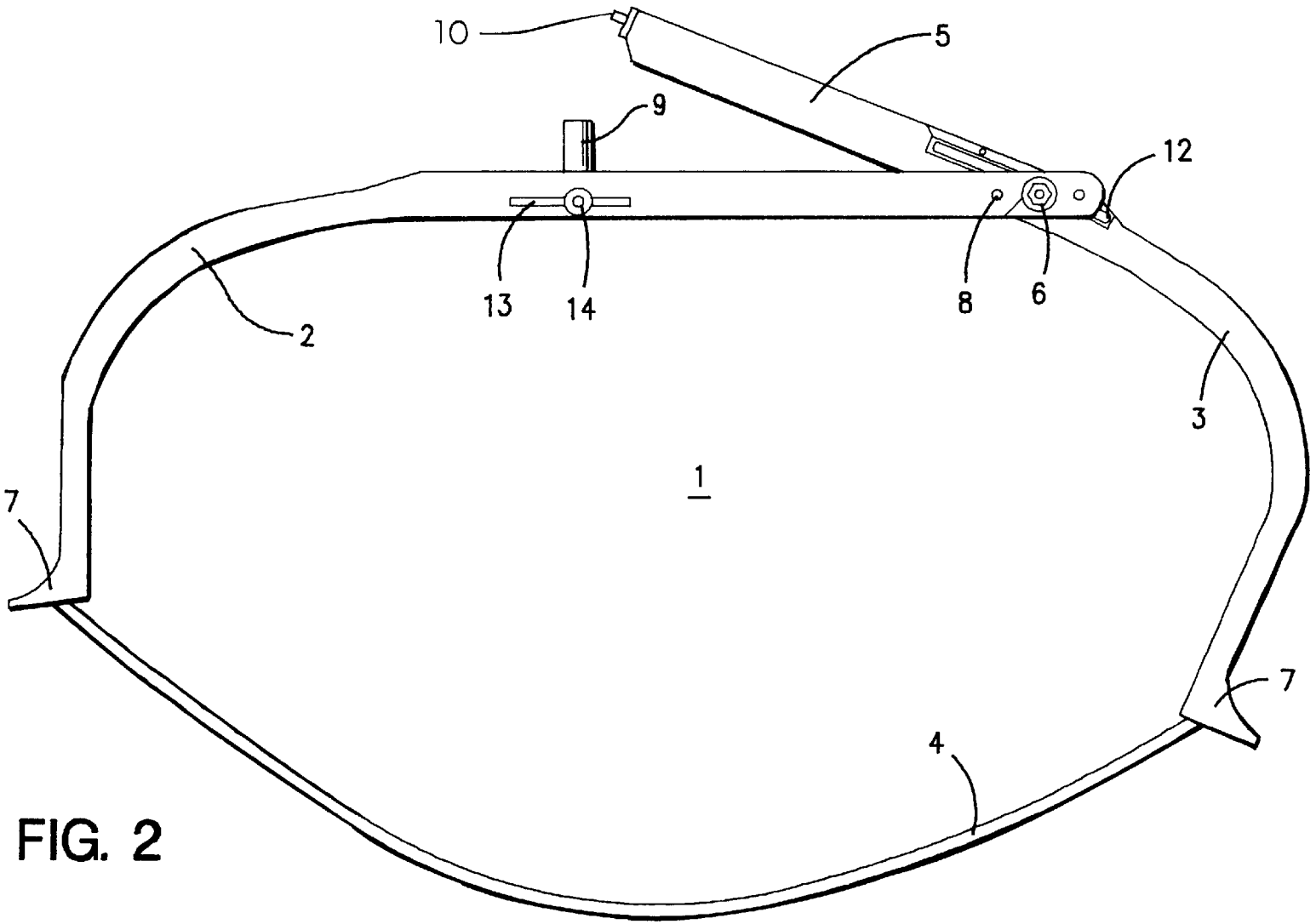
FIG. 2 shows the same embodiment as FIG. 1 in a relaxed position, seen from the side.
Figure 3:
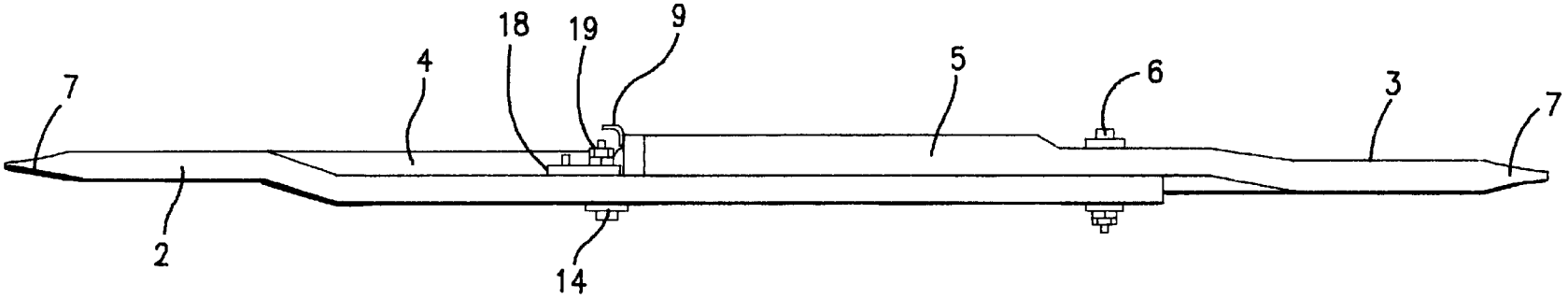
FIG. 3 shows the same embodiment as FIG. 1, seen from above.

A basic embodiment of the present bow for stringed instruments is shown in FIGS. 1, 2 and 3. The stick 1 is divided into two parts, 2, 3 which are rotatably joined about an axis 6. Each of the parts of the stick 2, 3 preferably consists of substantially straight parts connected to an arched part so that the stick 1 when assembled receives a somewhat wide and stretched-out U-shape. The hair 4 is attached to the ends 7 of parts 2, 3. Because of the U-shape of the stick, there is a relatively great distance between the hair 4 and the stick along most of the longitudinal direction of the stick 1 when the hair 4 is taut. Because of this distance a great deal of slack can be allowed in the hair 4 without causing a conflict between the stick 1 and the strings of the instrument during the playing.

One of the parts of the stick 3, is extended beyond the axis 6 as the arm 5. When using the bow, the person playing, or the string player, grasps around part 2 of the stick and around the arm 5. The string player can then adjust the tension of the hair 4 by pressing the arm 5 down toward part 2 of the stick and optionally even below it. The hair 4 of the bow can now be drawn across the strings of the stringed instrument at the same time as the musician can adjust the tension of the hair 4 by pressing together the hand holding the stick and thereby pressing the arm 5 toward part 2 of the stick. The more forcefully the arm 5 is tightened, the greater the tension of the hair 4 becomes. In the absence of pressure, i.e., when the hand does not push against the arm 5, the hair 4 becomes slack. By regulating the force by which the hand controls the arm 5, there is obtained an infinitely variable adjustment of the tension of the hair 4.

The axis 6, constituting the rotatable joint of the parts 2, 3 of the stick, is for example a screw, which passes through both parts, and a nut. In order to regulate the maximum tension of the hair 4, the placement of the axis 6 in the parts 2,3 of the stick can be adjusted. This adjustment can be achieved by moving the axis 6 between different previously drilled holes 8 on one part 2 of the stick and/or by making the axis 6 on one of the parts 2,3 of the stick pass through a longitudinal track 12. For example, by tightening a nut or by some similar arrangement the axis 6 can be fixedly secured in the track 12. Thus, the maximum tension of the hair 4, occurring when the stick is in a locked position or when maximum pressure is exerted by the string player, can be adjusted by a stepwise and/or a continuously variable regulation.

Figure 4:
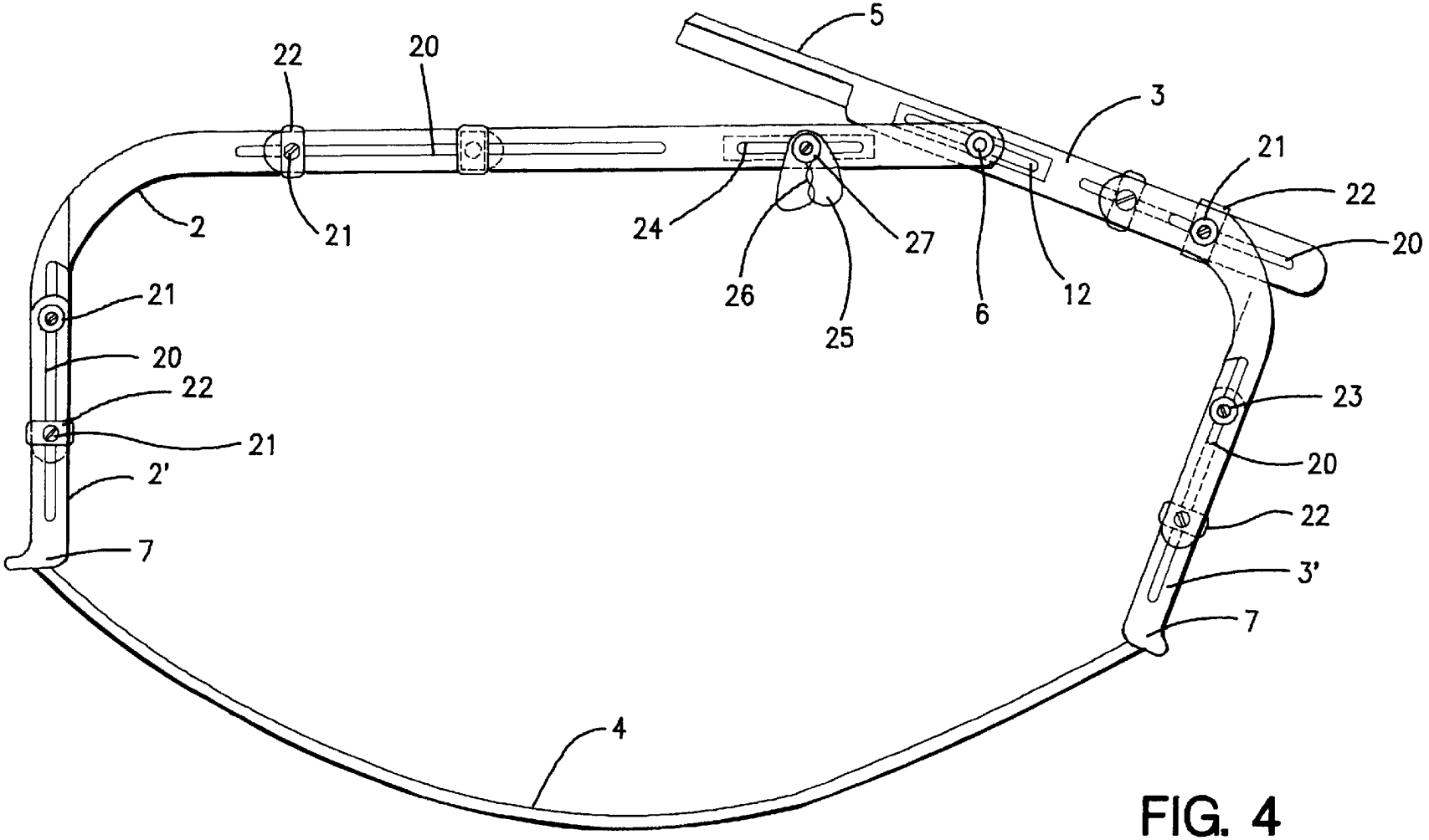
FIG. 4 shows a preferred embodiment of the present bow in a relaxed position.
Figure 6:
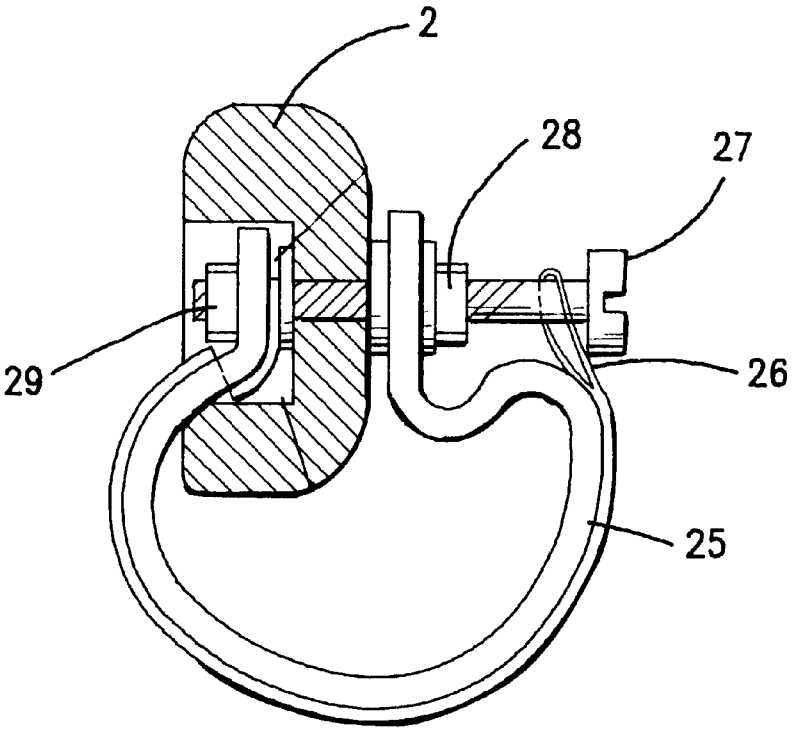
FIG. 6 shows a cross section of the stick through the thumb ring.
Figure 5:
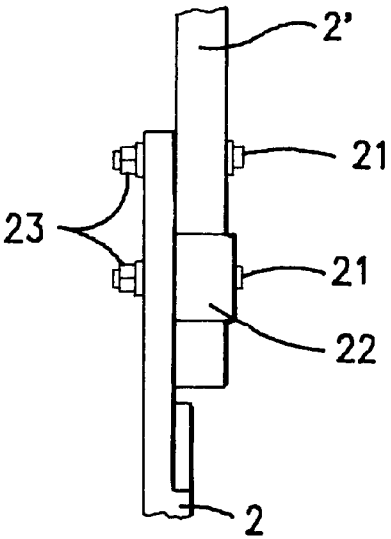
FIG. 5 shows an extension piece, seen from the edge of the stick.

The placement of the axis 6 in the longitudinal direction of the stick is partly dependent upon the personal taste of the performer, but is also determined by the possibilities of movement of the performer's arm. Thus, it is preferred that the bow should permit the performer to use as much as possible of the total length of the hair when he draws it across the strings of the instrument. The depth of the U-shape of the stick 1 and the maximum slack of the hair 4 will also be controlled by the same considerations as above. For this reason, and for the purpose of adjusting the maximum tension of the hair 4, it may be preferred to adjust the length of the substantially straight sections of the stick parts 2, 3 telescopically. In the embodiment shown in FIG. 4 this is accomplished by adjustment means, one of which is shown, seen from the side, in FIG. 5, its separate parts being disclosed by reference numerals 20, 21 and 22 in FIG. 4. In the depicted embodiment these are constructed in such a way that two adjustment screws 21, attached to one part, can be displaced in an adjustment track 20 in the second part. The adjustment means can be locked in a desired position by tightening the adjustment nut 23. The adjustment means can optionally be reinforced by a reinforcement piece 22, as shown in FIGS. 4 and 5.

Figure 7:
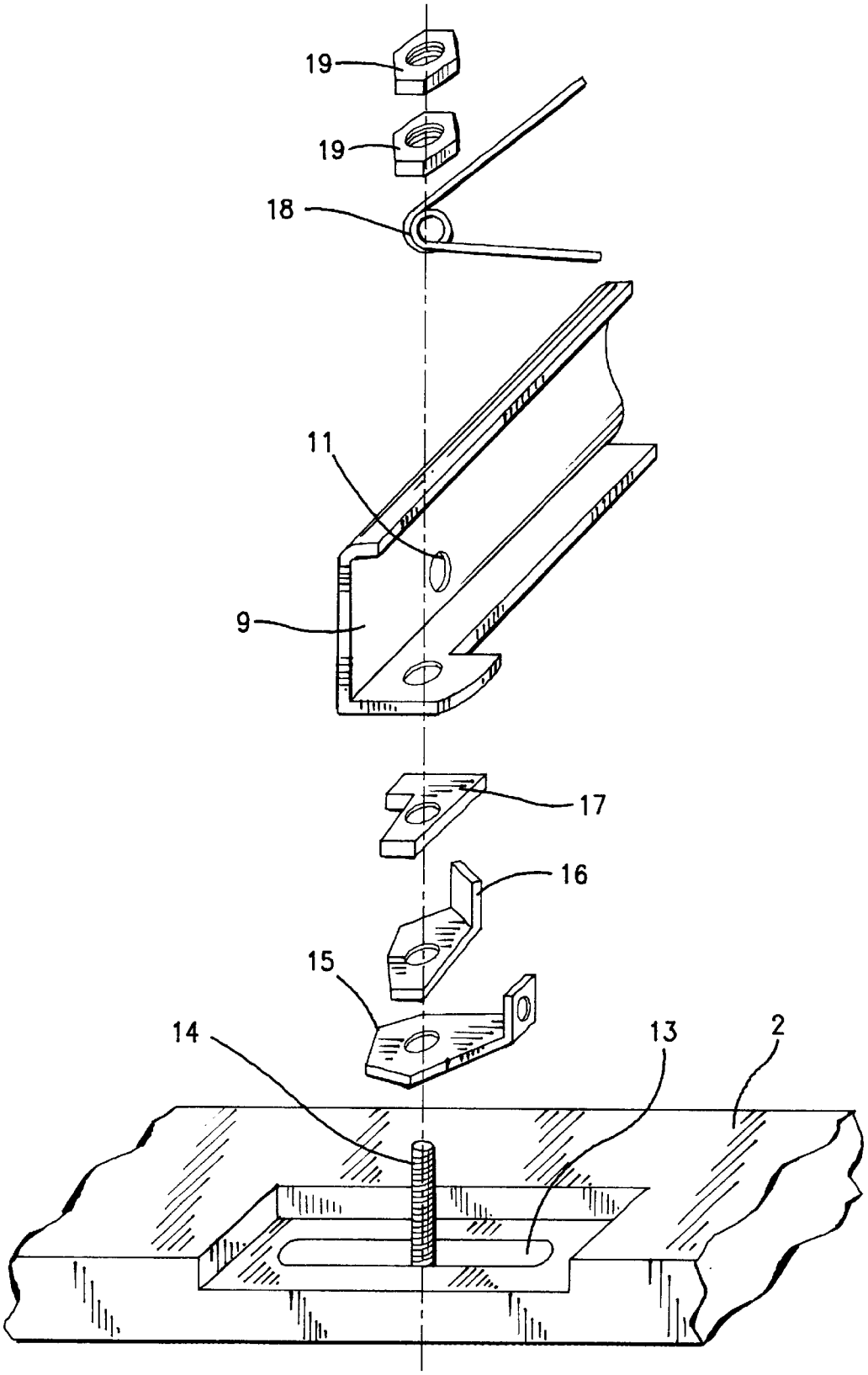
FIG. 7 shows an exploded view of an embodiment of the locking device.

If it is required to play with taut hair 4 for a long time or if taut hair 4 is desirable in order to make the bow bounce on the strings, it may be advantageous to use a device which can lock the arm 5 onto the part 2 of the stick in this position. Such a lock is shown in FIGS. 3 and 7, in the form of a tap 10 at the end of arm 5 which can engage with hole 11 on the tongue piece 9 when the arm 5 is approximately adjacent and parallel to a section of part 2. The tongue piece 9 which is mounted on the stick part 2 is preferably spring loaded, for example as shown by spring 18 in the drawing, so that it is automatically locked. The lock is opened by a pressure against the tongue piece 9. However, there are different ways in which this locking can be achieved. In pieces of music where there are quick changes between parts requiring taut hair and parts requiring slack hair, it will, nevertheless, be advantageous that the locking device can be deactivated, to prevent unintentional locking.

The depicted locking device must be moved, by means of an adjustment of the axis 14, in order to engage with the locking tap 10. The placement of the locking device can be adjusted by loosening the adjustment screw 14 and moving the screw in track 13 before the screw is tightened anew. FIG. 7 shows a preferred locking device in an exploded view. The adjustment screw 14 runs in track 13 and keeps the parts of the locking device together. Preferably the locking device is partly embedded in the stick part 2 as shown in the drawing. The intermediate pieces 15, 16, 17 lie between the stick part 2 and the tongue piece 9 and have the function of guiding the tongue piece. The spring 18 presses the tongue piece against the locking tap 10 in order to ensure engagement between the locking tap 10 and the hole 11 of the lock.

The locking device may comprise other structures and arrangements, however, without these being specifically described here.

In order to ensure the best possible control of the bow for the player, it is preferred that the stick be provided with a thumb ring 25 wherein the performer inserts his thumb when using the bow. The thumb ring is preferably of skin, leather or of a material having similar characteristics. The thumb ring 25 is placed in such a way that the player, inserting his thumb therein, obtains good control of the bow while the other fingers of the hand grip the arm 5. For the purpose of adjusting the position of the thumb ring 25 according to personal preference and in order to adapt to other positions of the stick 1, the fastening screw 27 can be displaced along the adjustment track 24 of the stick part 2 and be fixed at the desired position by means of nuts 28, 29. A thread 26 can be used for adjusting the diameter of the thumb ring according to the size of the thumb. The thread 26 is preferably double and runs on the outside of the thumb ring 25. By twisting the threads more or less tightly in relation to each other, this diameter can be fixed.

Since it is difficult to obtain as much tension of the hair 4 with the the present bow 1 as with a traditional bow, a stringed instrument has been developed which overcomes the problems arising from a slack bow, viz. that the hair unavoidably will touch more than one string when this is not intended.

Figure 14:
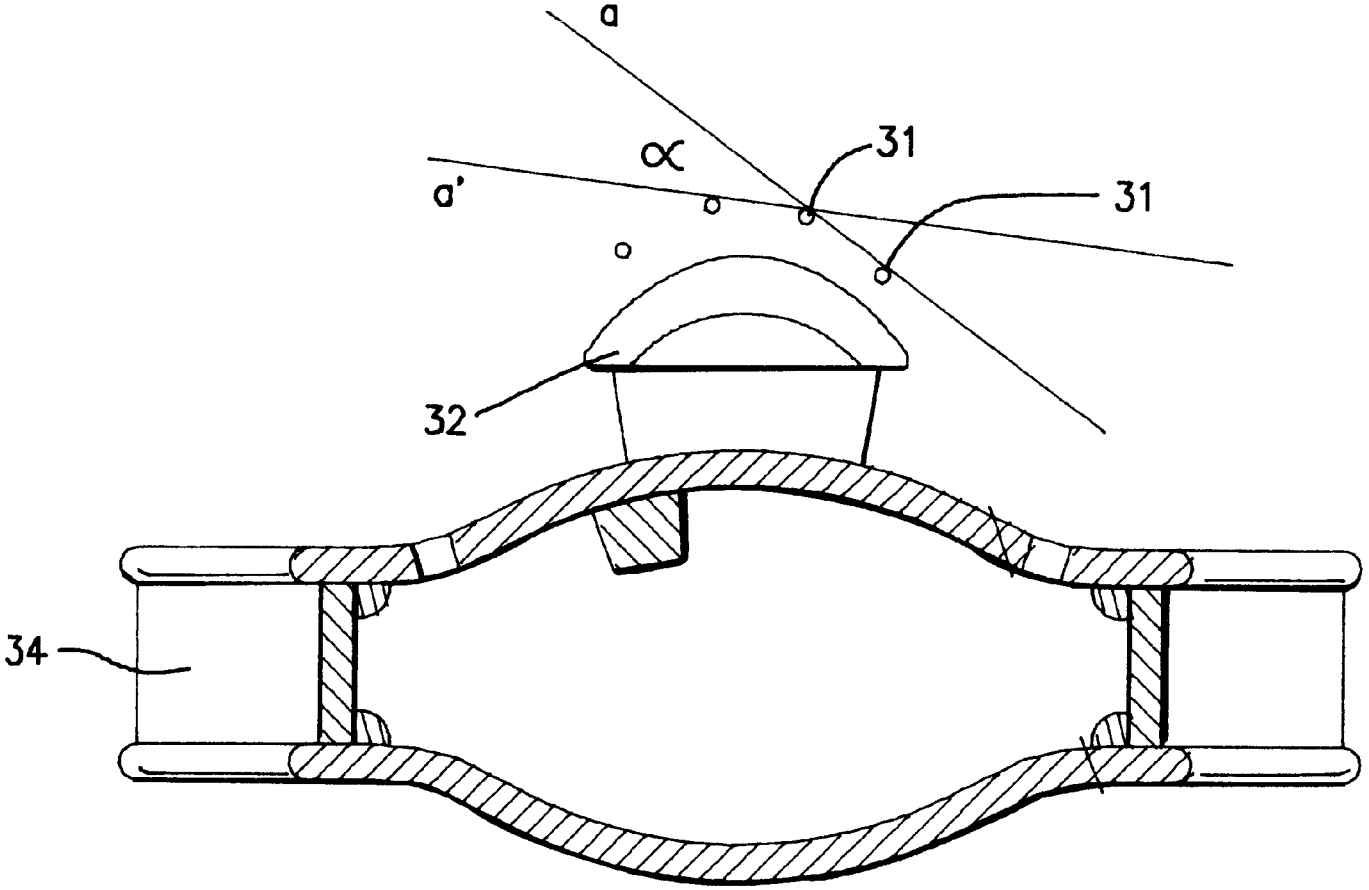
FIG. 14 shows cross section E—E from FIG. 8 of a violin according to the present invention.

The area of a stringed instrument on which the bowing occurs lies generally between the bridge and the fingerboard. The cross section of a stringed instrument shown in FIG. 14 is from this area. A plane a can here be defined between a first string (not an outermost string) and the neighboring string. A second plane a' can be defined by the same first string and the neighboring string on the other side. The angle of intersection $\alpha$ between these planes a and a' varies from instrument to instrument and may be different when based on a different string of the same instrument. The larger the instrument is, the larger is the angle, and the angle is smaller for a string producing a high note than for a string producing a low note. Thus the angle varies from about 14° based on the second string of a ⅛ violin to about 25° based on the third string of a double bass. For the present improved stringed instrument the angle $\alpha$ is at least 3°, preferably at least 5° and most preferably at least 7° greater than what is customary for this type of instrument. This angle $\alpha$, when based on the second string of a full-size violin according to the invention, will be greater than 25°, preferably greater than 27°. For a double bass this angle, based on the third string, will typically be greater than 28°, preferably greater than 31°.

Figure 10:
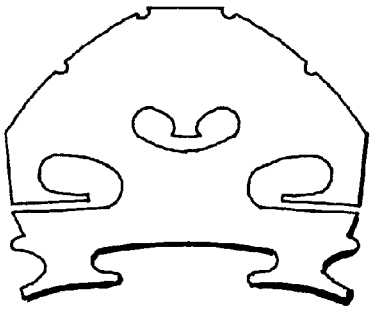
FIG. 10 shows a bridge to be used with the present bow.
Figure 9:
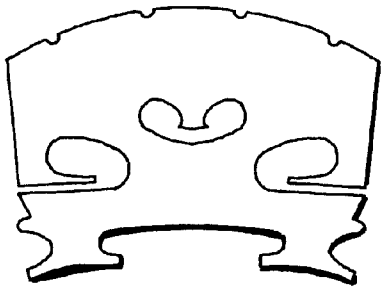
FIG. 9 shows an ordinary bridge.
Figure 8:
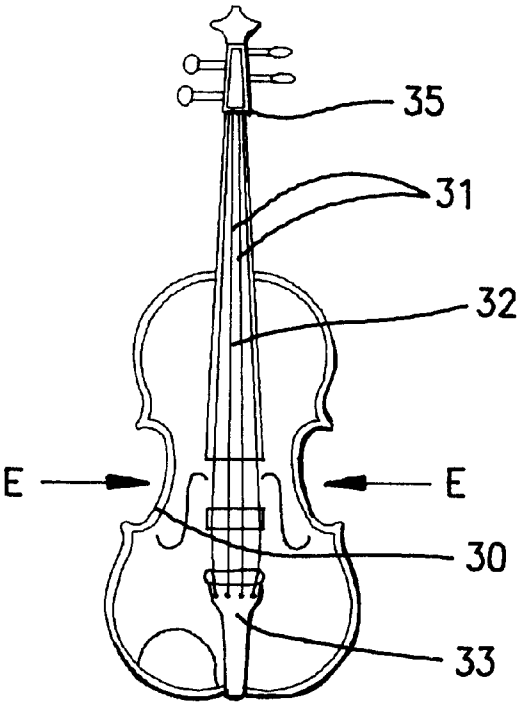
FIG. 8 shows an ordinary violin seen from above.

An increase in the angle between these planes or a reduction of the radius of curvature pertaining to the arc described by the string can be made in two ways. For a traditional stringed instrument this is most simply accomplished by exchanging the bridge 30 of the instrument with a bridge 30' having a smaller radius of curvature. A traditional bridge 30 has a curvature as shown in FIG. 9, whereas it is preferred, for the present bow, to use a bridge as shown in FIG. 10. However, as a temporary solution when it is desirable to use the same instrument with both the traditional bow and the present bow, a base may be built up underneath the middle strings of the instrument in order to achieve this curvature of the strings. A change of bridge demands, of course, that all strings be loosened at the same time, a circumstance which involves the extensive and intricate work of tightening and tuning. A change of bridge will therefore be more permanent than a build-up. Newer instruments may also be envisaged, such as an electric violin, without a bridge, but where the stringholder describes the desired arc. On such instruments the desired curvature between the strings can be achieved in another manner.

For the violin to be played with ease, the curvature of the fingerboard 32 must be such that all strings are positioned at approximately the same distance above the fingerboard. The fingerboard ought therefore to be exchanged. This exchange may be permanent, i.e., the fingerboard of the instrument may be shaped with the curvature required for the present bow. However, since a stringed instrument, for example, is relatively expensive, it must be assumed that it will be desirable to find solutions where the instrument can be used both with the traditional bow and the present bow.

The fingerboard, which is mounted on the neck of the instrument, can be detached and exchanged with a new fingerboard having the desired curvature. The exchange of fingerboards can be carried out by means of different forms of temporary attachments, but the strong forces to which the fingerboard is exposed through the pressure of the strings make stringent demands on the fastening. The neck of the instrument is often not sufficiently strong to absorb this pressure alone, but must be additionally reinforced by means of the fingerboard. In addition, the fingerboard must be so well secured that it can withstand the player's pressure against the strings on the end of the fingerboard closest to the bridge. This fastening can be made by means of soluble adhesive, screws, taps and/or a form of rapid coupling. For acoustic reasons it may be preferred not to use any metal parts for this connection. Another point to be noted, unless the instrument is to be permanently refashioned, is that the exchange should be possible without requiring all the strings to be loosened at the same time. A tightening of the strings and a tuning of the instrument is a time-consuming and difficult operation.

Figure 11:
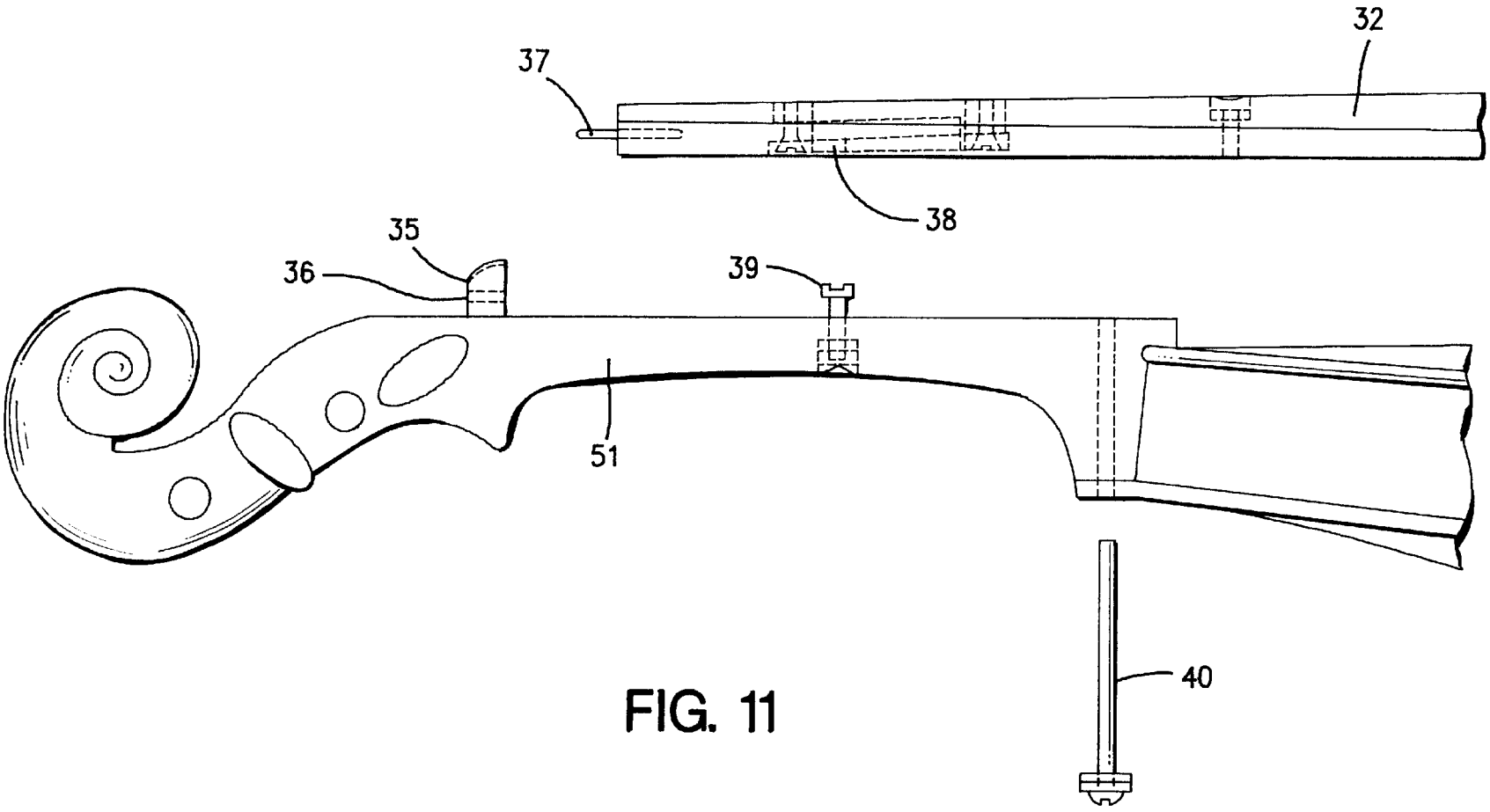
FIG. 11 shows an embodiment of the neck and exchangeable fingerboard according to the invention.
Figure 12E:
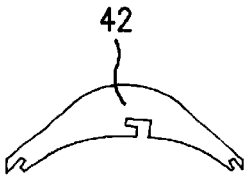
FIGS. 12*d* and 12*e* show cross sections of two different fingering parts adapted to the base part shown in FIGS. 12*a* and 12*b;*
Figure 12D:
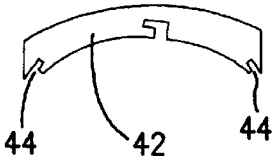
Figure 12A:
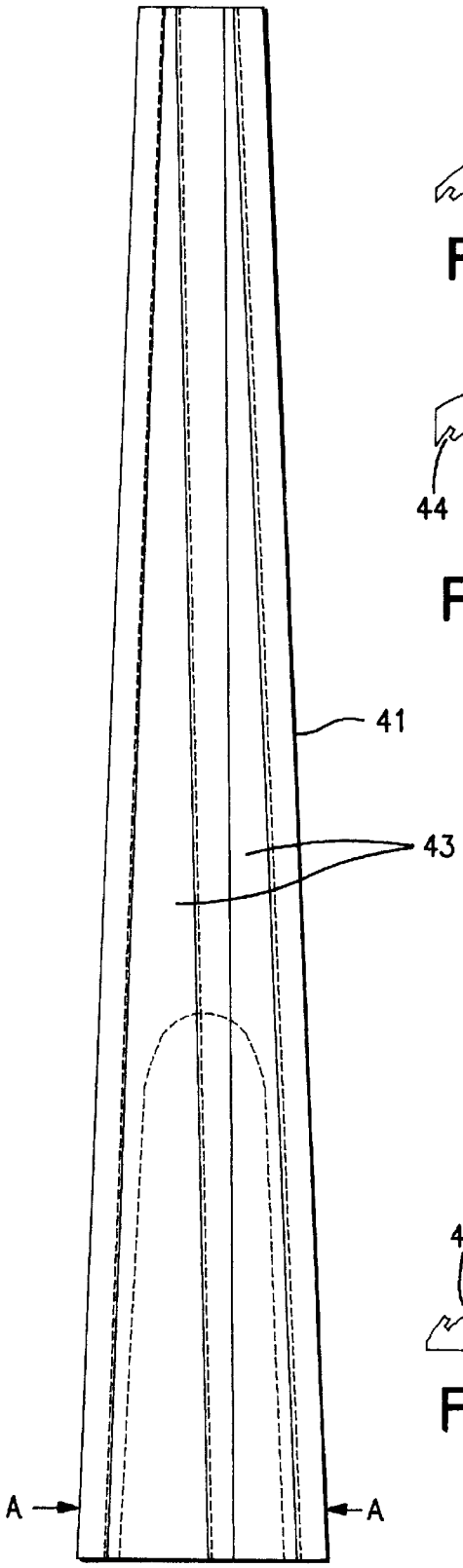
FIG. 12*a* shows an embodiment of a base part of a fingerboard seen from above.
Figure 12B:
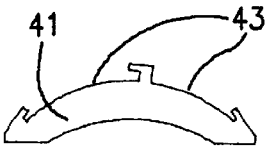
FIG. 12*b* shows a cross section A—A of FIG. 12*a;*
Figure 12C:
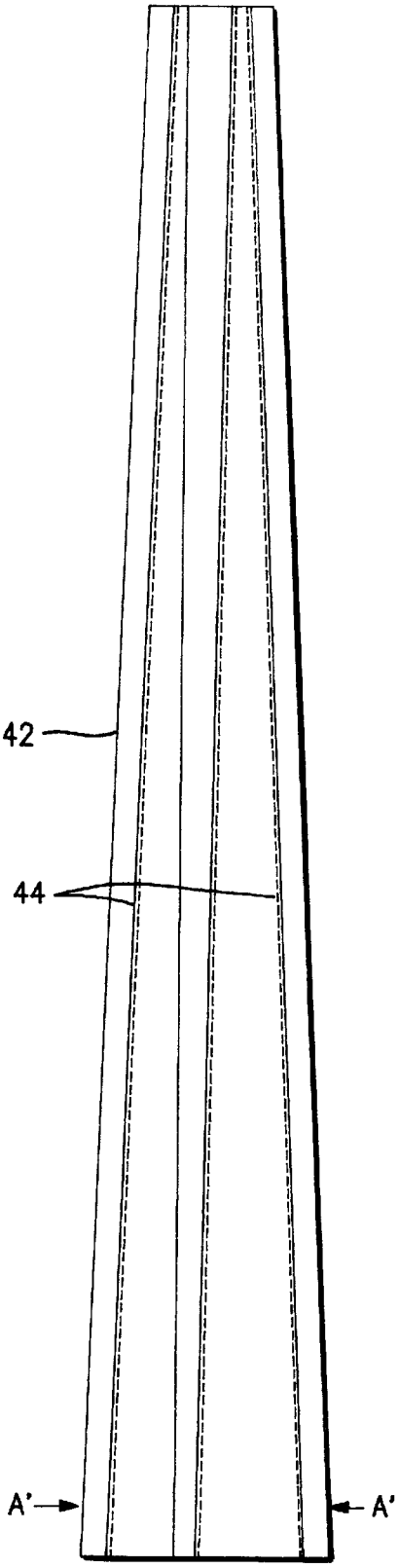
FIG. 12*c* shows a fingering part of said fingerboard seen from below.

FIG. 11 shows an embodiment of an exchangeable fingerboard combining the use of taps 37, rapid coupling 38 and bolt 40. The fingerboard 32 is first attached by means of rapid coupling 38, screw 39 and taps 37 to the neck 51 of the instrument, respectively holes 36 in the nut 35 (the ridge on the upper end of the fingerboard). Thereafter, the whole is secured by means of the bolt 40. According to this embodiment the exchange occurs by the player loosening only one string at a time and tightening this before the next string is loosened. Accordingly, it is preferred to use exchangeable devices which obviate the need to loosen all strings simultaneously.

In FIGS. 12–13 different exchangeable devices have been depicted.

In the embodiments shown in FIGS. 12 and 13 the fingerboard is divided into two parts, a lower or base part 41 and an upper or fingering part 42. The base part 41 is mounted fixedly on the neck of the instrument 51 whereas the fingering part 42 can be exchanged. To provide a simple and reliable exchange, the base part 41 is equipped with tracks 43 adapted to engage with corresponding tracks 44 of the fingering part 42. The design of these tracks may be different, for example as shown in FIGS. 12 and 13, but their common feature is that the fingering part 42 can be set down into the base part 41, whereupon the fingering part 42 is displaced in the longitudinal direction in relation to the base part 41 so as to be secured in the desired position. When correctly designed, the fingering part 42 may then be exchanged without any need to loosen the strings. If necessary, the fingering part 42 and the base part 41 can be provided with a locking device ensuring that the parts will not be displaced in relation to each other during performance. This solution makes it possible to have different fingering parts 42 with different curvatures, i.e., one for use with the traditional bow and one for use with the present bow, the parts being interchangeable by simple manipulation when required. Other possibilities of fastening the fingering part 42 to the base part 41 are also envisaged, such as, for example, taps on the bottom side of the fingering part 42, which are capable of engaging with corresponding holes in the base part 41. Another possibility is the fastening of the fingering part 42 to the base part 41 by means of threads passing through holes traversing the fingering part 42, the threads being fastened in such a manner that they do not interfere with the playing.

Combinations of the above embodiments of exchangeable devices are also conceivable. The base part 41 may be mounted fixedly or exchangeably on the neck 51 of the instrument.

Figure 13A:
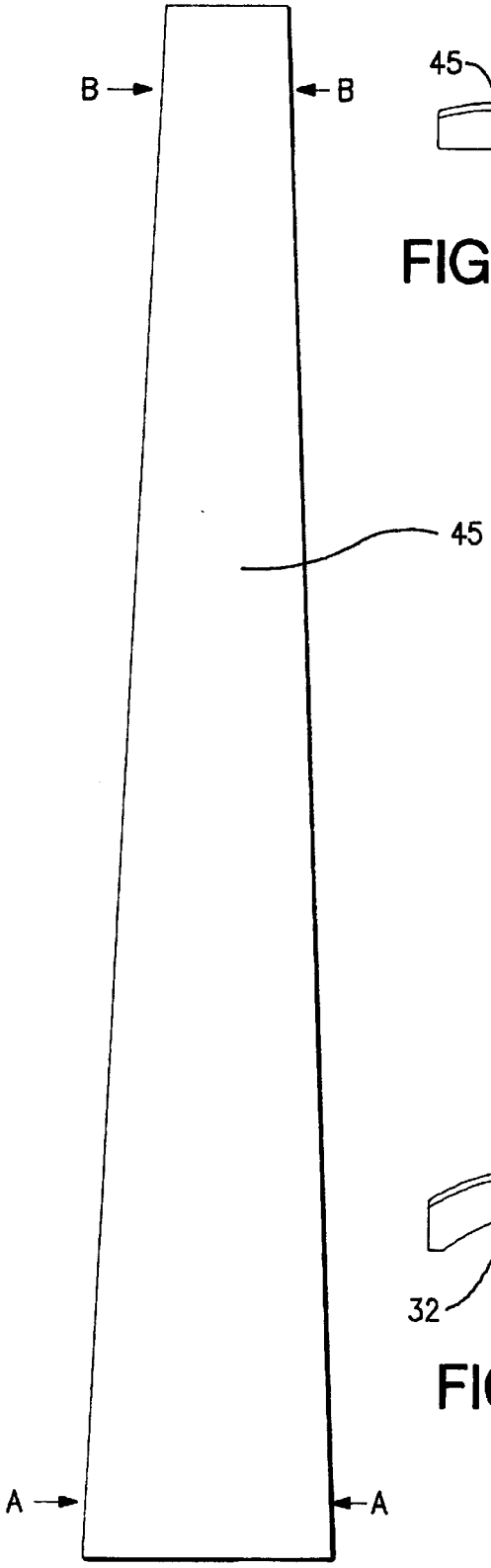
FIG. 13*a* shows the adapter on the fingerboard seen from above.
Figure 13D:
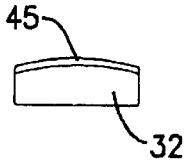
FIGS. 13*b* and 13*d* show respectively A—A and B—B of a fingerboard with adapter.
Figure 13E:
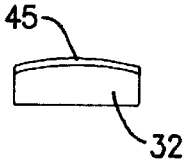
FIGS. 13*c* and 13*e* show the same cross section as FIGS. 13*b* and 13*d*, but with another adapter.
Figure 13B:
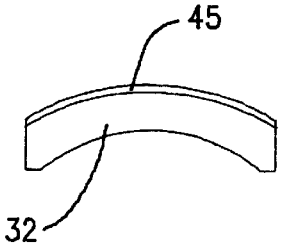
Figure 13C:
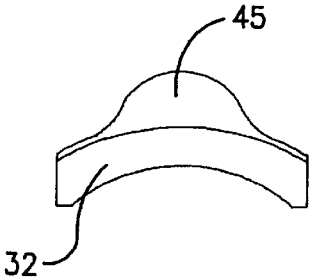

A further alternative for altering the curvature of the fingerboard in a temporary manner is to use an adapter 45 which can be fixedly secured on the fingerboard 32 of the instrument, for example by means of a two-sided tape. If the embodiment shown in FIG. 13 is used, the instrument must be altered by building the nut 35 higher or by raising the area between the nut and strings corresponding to the adapter 45 of the smallest possible thickness, i.e, about 1 millimeter. As long as the nut 35 is raised according to this device, an adapter must therefore be used, either one of even thickness for playing with the traditional bow or one raised in the middle as shown in FIG. 13*c* for use with the present bow.

Figure 15:
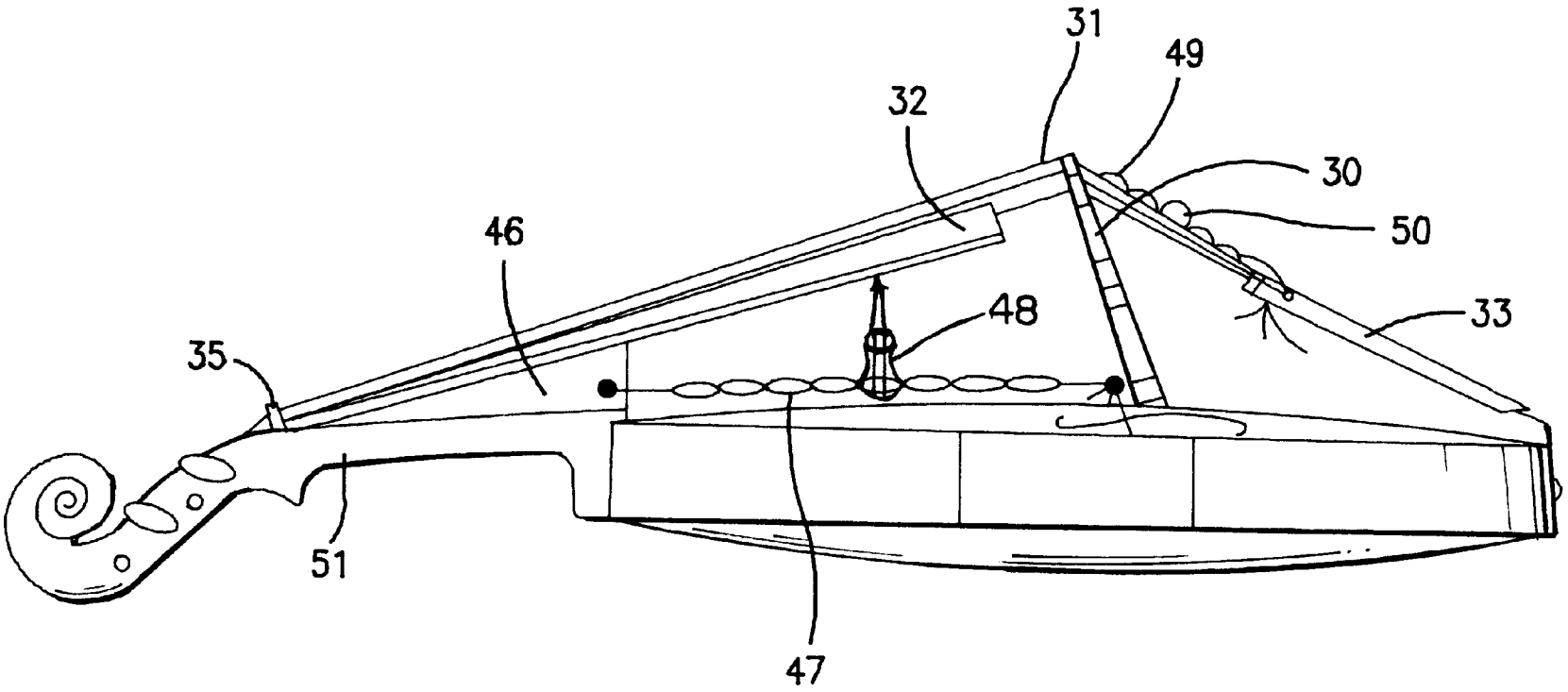
FIG. 15 shows a stringed instrument according to the present invention, having a high bridge, seen from the side.

The angle between the plane defined by an outermost string and the neighbouring string and the plane defined by the edge of the instrument where the hair 4 during normal playing comes closest to the resonance box and the outermost string sets the limits for the maximum size of the angle formed when the musician plays on the outermost string without simultaneously touching the resonance box. For convenience of playing, this angle ought to be as large as the angle between the planes defined by the strings. This can be achieved in two ways, one solution being to build a new stringed instrument which is as slender as required, optionally, having such a slim waist that this angle fulfills the requirements. A more slender instrument than usual, optionally a slimmer waist, may also be combined with a higher bridge than usual. It is also possible to alter an ordinary instrument. The desired angle can then be achieved, as shown in FIG. 15, by building the bridge higher than usual, for example, for a full-size violin, 2–3 times as high as an ordinary bridge, or about 6–9 centimeters. Tests of violins having a bridge of 8 centimeters have given good results.

However, when a stringed instrument is altered, attention must be paid to the fact that the bow is to be drawn perpendicularly to the strings, preferably in the accustomed area. i.e., between the fingerboard and the bridge, at the same time as the hair of the bow must pass along the waist of the instrument when the outermost strings are played, so as to avoid drawing the bow against the box of the instrument. Moreover, this area and the fingerboard must have a length corresponding to what is customary for this type of instrument. This involves certain geometric limitations entailing that the part of the bridge on which the strings rest must be placed further forward toward the head of the instrument than what is customary. The foot point of the bridge, i.e, where the bridge rests on the box, must lie directly above the sound post inside the box. This entails that the bridge must be placed slantwise on the box. In order to make sure that the bridge does not slide against the box but keeps its position in relation to the strings, it will be necessary to fasten the bridge, for example as shown in FIG. 15, where a tension cord 47, attached to the bottom of the bridge 30 and to the neck 51 or wedge 46 and capable of being tightened by means of a tension adjuster 48, ensures that the bridge 30 does not slide on the table of the instrument. Correspondingly, a similar tension cord 49, attached to the top of the bridge 30 and to the string holder 33 can be tightened by a tension adjuster 50 and prevent that the bridge 30 slides on the strings. If the sound post can be moved, the foot point of the bridge should also be moved, so that the bridge stands perpendicularly to the table. In that case there is no need to secure the bridge as mentioned above. However, such a move of the sound post may have undesirable acoustic effects.

If the bridge is to be built higher than that for which the instrument was originally designed, the fingerboard must also be raised, for example by means of a wedge 46 as shown in FIG. 15, so that the strings run approximately parallel to the fingerboard. A more permanent solution may be to exchange the neck with a new neck having the correct angle in relation to the longitudinal axis of the instrument box.

I claim:

1. A bow for a stringed instrument comprising:

a stick divided into first and second parts;

said first part comprising a first end, a second end, and an axis point;

said second part comprising a third end, a fourth end, a joining point intermediate said third and fourth ends, and an arm extending from said third end to said joining point;

said first part axis point and said second part joining point rotatably joining said first part and said second part about said axis point; and a hair having ends attached to said first and fourth ends forming said hair into a straight line therebetween;

wherein said arm is designed and adapted to act as a lever for adjusting tension on said hair by a performer moving the arm relative to said first part.

2. The bow of claim 1, wherein said ends are fixedly attached to said first and fourth ends.

3. The bow of claim 1, wherein said hair remains free from contact with said first and second parts except at said first and fourth ends.

4. The bow of claim 1, wherein said axis point is intermediate said first and fourth ends.

5. The bow of claim 1, further comprising means for locking together said first part and said second part in which position said hair is taut.

6. The bow of claim 1, wherein said second part further comprises an adjustment means for varying the location of said joining point intermediate said third and fourth ends designed and adapted for varying a length of said an arm extending from said third end to said joining point.

7. The bow of claim 5, wherein said adjustment means permits stepwise adjustment of said arm length.

8. The bow of claim 1, wherein one of said first part and said second part further comprise means for telescopically adjusting a length of said one of said first part and said second part.

9. The bow of claim 1, further comprising a thumb strap mounted on one of said first part and said second part designed and adapted to permit the performer to place a thumb of a hand inside said bow and the other fingers of the hand around and pressing against said arm.

10. The bow of claim 1, wherein said arm is designed and adapted to act as a lever for adjusting tension on said hair by the performer while the performer is playing said instrument.

11. The bow of claim 1, wherein said axis point is located intermediate playing ends of said hair.

12. A bow comprising:

a stick;

a hair;

said stick comprising two parts variably joinable to form plural U-shape bow configurations about a pivot axis interior to a playing region of said hair; and an arm extending from said pivot axis for adjusting the shape of the bow.

* * * * *